US005121167A

United States Patent [19]

Gundlach

[11] Patent Number: 5,121,167

[45] Date of Patent: Jun. 9, 1992

[54] SWEEP AND VACUUM XEROGRAPHIC CLEANING METHOD AND APPARATUS

[75] Inventor: Robert W. Gundlach, Victor, N.Y.

[73] Assignee: Xerox Corporation, Stamford, Conn.

[21] Appl. No.: 544,439

[22] Filed: Jun. 27, 1990

[51] Int. Cl.[5] ..... G03G 21/00

[52] U.S. Cl. ..... 355/296; 15/308; 355/297; 355/302

[58] Field of Search ..... 355/296, 297, 298, 301, 355/302, 303, 304, 215, 269, 283; 15/306.1, 308; 101/425

[56] References Cited

U.S. PATENT DOCUMENTS

| | | | |
|---|---|---|---|
| 3,395,042 | 7/1968 | Herbert, Jr. | 15/308 X |
| 3,536,528 | 10/1970 | De Geest | 134/1 |
| 3,570,224 | 3/1971 | Clemens | 355/304 X |
| 3,668,008 | 6/1972 | Severynse | 134/1 |
| 3,728,016 | 4/1973 | Harbour, Jr. et al. | 355/296 |
| 3,741,157 | 6/1973 | Krause | 355/296 X |
| 3,743,540 | 7/1973 | Hudson | 134/1 |
| 3,795,025 | 3/1974 | Sadamitsu | 355/304 X |
| 4,007,983 | 2/1977 | Knieser | 355/297 |
| 4,014,065 | 3/1977 | Hudson | 15/306 |
| 4,026,701 | 5/1977 | Till et al. | 355/296 X |
| 4,121,947 | 10/1978 | Hemphill | 134/1 |
| 4,515,467 | 5/1985 | Suzuki | 355/302 X |
| 4,522,488 | 6/1985 | Fisher | 355/304 |
| 4,610,534 | 9/1986 | Ito et al. | 355/15 |
| 4,806,981 | 2/1989 | Ishiguro et al. . | |
| 4,878,093 | 10/1989 | Edmunds | 355/298 X |

FOREIGN PATENT DOCUMENTS

| | | | |
|---|---|---|---|
| 60-11869 | 1/1985 | Japan | 355/298 |
| 1-250982 | 10/1989 | Japan | 355/297 |
| 1439229 | 6/1976 | United Kingdom | 355/296 |

OTHER PUBLICATIONS

Hewitt et al, "Photoreceptor Cleaning", Xerox Disclosure Journal, Sep./Oct. 1978, vol. 3, No. 5, pp. 353-354.

Iannettone et al, "Vacuum Cleaning Shoe with Planar Vortex Air Flow", Xerox Disclosure Journal, Nov./-Dec., vol. 2, No. 6, pp. 119-120.

Crooks, "Electrophotographic Cleaning Apparatus", Apr. 1970, IBM Technical Disclosue Bulletin, vol. 12, No. 11, pp. 1819.

*Primary Examiner*—A. T. Grimley
*Assistant Examiner*—Shuk Y. Lee
*Attorney, Agent, or Firm*—William A. Henry, II.

[57] ABSTRACT

A cleaning device for an electrostatographic copying machine collects residual toner from a photoconductive surface of the copying machine by the use of fiber-like bristles adhered to a face of a slit through which air is pulled by a vacuum pump. The bristles are pressed gently into sliding contact with the imaging surface and thereby loosens the toner for capture by the vacuum pump through the slit. An alternative would be to use open-cell foam in place of the bristles.

7 Claims, 2 Drawing Sheets

SWEEP AND VACUUM XEROGRAPHIC CLEANING METHOD AND APPARATUS

FIELD OF THE INVENTION

The present invention relates to an improved cleaning method and apparatus that collects residual toner from the photoconductive surface of an electrophotographic copying machine by using a vaccum slit and fiber-like bristles or open-cell foam padding.

BACKGROUND OF THE INVENTION

Conventionally, there are a variety of methods used for cleaning residual toner from the surface of a photoconductor. For example, U.S. Pat. No. 3,536,528 discloses a method and apparatus for cleaning toner particles from the surface of a web. The removal of freed particles from the vicinity of the web material is achieved by one or more air currents maintained by suction and/or blowing devices. A cleaning head with wedge-like channels having a rectangular cross section and a plurality of ducts. Pressurized air is fed therethrough one duct to a channel. Air laden with particles is removed from a web and carried through another of the channels. An ionized air cleaning device is shown in U.S. Pat. No. 3,668,008 for use in an automatic xerographic reproducing machine. The apparatus is adapted to clean residual toner powder images from a photoreceptor where an ionized air flows to the surface to be cleaned and neutralizes the particles thereon to allow the particles to be readily removed. The ionized flow may be directed aganist the surface to neutralize the particles, allowing for removal by a brush or vacuum nozzle. In U.S. Pat. No. 3,743,540 a method and apparatus for cleaning a residual toner power image surface by ionized flow is shown. Fans or air pumps are utilized to direct a flow of ionized air to the surface to be cleaned. The air flow neutralizes any change of the residual particles remaining on the surface to allow the particles to be readily removed. U.S. Pat. No. 4,014,065 discloses a vacuum removal means for removing excessive developer material from a member having a latent magnetic image developed with magnetic developer material. The vacuum removal means comprises a chamber having entrance and exit ports sized such that the ratio of entrance port to exit port is sufficiently small to assure substantial uniform air flow across the entrance port when the chamber is subjected to a negative pressure through the exit port. In U.S. Pat. No. 4,121,947 a method of cleaning a photoreceptor includes the steps of exposing a photoconductive layer of the photoreceptor to light, charging the photoconductive layer, vibrating the photoreceptor to dislodge the toner therefrom and subjecting the toner to a force such as vacuum or gravity which draws the toner away from the photoreceptor. U.S. Pat. No. 4,610,534 discloses a cleaning device for copying machines which collects residual toner from a photoconductive surface of a copy machine by using a rotary brush and deposits the collected toner into a specific part such as a filter. The residual toner is forced into the filter by a vacuum means which includes an air duct formed between a specific part of the rotary brush and a vacuum activating fan mounted inside the air duct. All of the above-reference patents are included herein by reference to the extent necessary to practice the present invention.

SUMMARY OF THE INVENTION

As is now apparent, common methods of cleaning in use in current copiers are brush cleaning, web cleaning, blade cleaning and electrostatic brush (magnetic brush or carrier bead) cleaning. Fur brush cleaning has been used since the 1950s. The complexity of a high speed rotating brush makes it costly and it is also space consuming. Web cleaning dates back to the 1960s and its main problem is the cost of consumable webs, spooling of the web supply and of the take-up means. Blade cleaning is compact, but susceptible to nicking, lint collection, and "tuck under" problems. It also requires smoother photoreceptors, and needs selflubricating developers (such as one percent Kynar).

Electrostatic "developer" cleaning requires complete manual cleaning out of the equipment too frequently, or the use of forced air and a filter bag. Accordingly, if one must use forced air and a filter bag anyway, the present invention adds a compact, no moving parts (except for the air blower) cleaning method and apparatus which uses a vacuum slit and fiber-like bristles or open-cell foam padding. The foam covered or non-covered slit is pressed lightly into sliding contact with an imaging surface to be cleaned, the foam padding acting like a random array of cleaning blades permitting toner to be carried away be the moving air. Similarly, the fiber-like bristles are adapted for positioning in sliding contact with an imaging surface and connected to a vaccum source such that toner that is loosened on the imaging surface by the fiber-like bristles is suctioned off the imaging surface by the vacuum source.

BRIEF DESCRIPTION OF THE DRAWINGS

The above-mentioned features and others of the invention, together with the manner of obtaining them will be best understood by making reference to the following specification in conjunction with the accompanying drawings, wherein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE DRAWINGS

Figure 1:
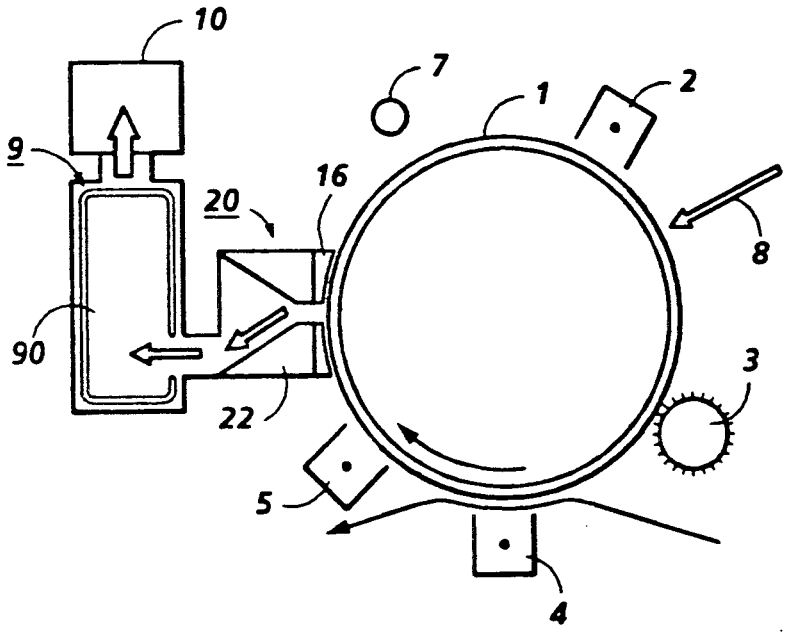
FIG. 1 is a simplified block diagram of a conventional copying machine containing a cleaning system as a preferred embodiment of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the cleaning apparatus of the present invention therein.

Inasmuch as the art of electrophotographic recording is well known, the various processing stations employed in the FIG. 1 recording machine will be shown hereinafter schematically and their operation described briefly with reference thereto.

Referring now to FIG. 1, there is shown by way of example, an automatic electrostatographic recording machine 10 that could be electrophotographic or electrographic, such as, ionographic means for latent image formation which includes a toner cleaning system. The reproducing machine depicted in FIG. 1 illustrates the various components utilized therein for producing copies from an original document. Although the apparatus of the present invention is particularly well adapted for use with automatic electrostatographic reproducing machines, it should become evident from the following description that it is equally well suited for use in a wide variety of processing systems including other electrostatographic systems and is not necessarily limited in application to the particular embodiment or embodiments shown herein.

The conventional reproducing machine illustrated in FIG. 1 employs the above-mentioned cleaning method and apparatus in which corona discharger 2, developer brush 3, transfer corona charger 4, charge corona charger 5, cleaning unit 20, and discharger lamp 7, are respectively provided around the photoconductive surface 1 at proper intervals. A latent image is formed on the photoconductive surface 1 by corona charger 2 and exposure light 8 and is developed by developer brush 3 before being transferred onto a copying paper by the transfer corona charger 4. After a transfer operation is completed, residual toner is then removed from the photoconductive surface 1 by neutralizing with corona discharger 5 and cleaning with cleaner 20 in accordance with the present invention before being sent to a filter 9 by a conventional vacuum source 10. Filter 9 is provided with a filter bag 90 containing an air filter that collects toner from the cleaner for deposit. A vacuum unit 10 absorbs the removed toner from the cleaner 20 into filter 9 and is provided above the filter. It should be understood that the cleaning device 2 is just as effective in a printer as a copier and with belt photoreceptors as with drum shaped photoreceptors, and also with belt or drum charge receptors in ionographic printers.

Figure 2:
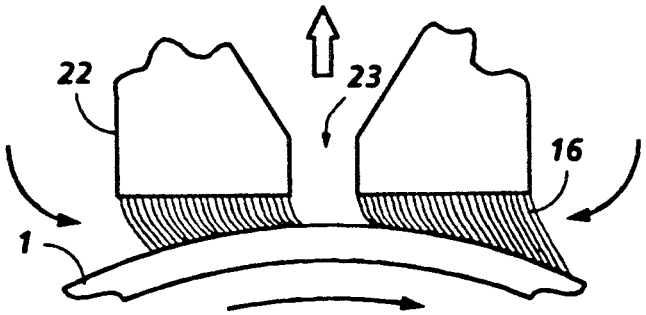
FIG. 2 is an enlarged, partial side view of the cleaning system of FIG. 1.

The cleaning apparatus 20 in the preferred embodiment shown in FIG. 2 comprises short velvet-like or fiber-like flocked bristles 16 embedded in or adhered to an impervious material. Contact with photoreceptor 1 is gentle and non-abrasive and resistance to air flow through the flocked bristles is minimal. A seamed photoreceptor shown as 25 will provide a "flicking" action to shake loose any adhering toner particles from the fibers. In operation, vacuum flow from vacuum source 10 of about 12 cm of water produces adequate air velocity where the fibrous, air pervious layer 16 rubs against and loosens the toner on the surface of rotating photoreceptor 1, so that the toner is carried into and thru a slit 23 where it passes into filter bag 90. The vacuum slit is preferably about 2.5 mm wide while the surfaces of housing 22 that are opposite photoreceptor 1 extend about 3 mm and bristles 16 (which comprise high pile precision acrylic fibers) are about 25 micrometers in diameter with a length of about 1.0 mm and a density of about 300,000/cm$^2$.

Figure 3:
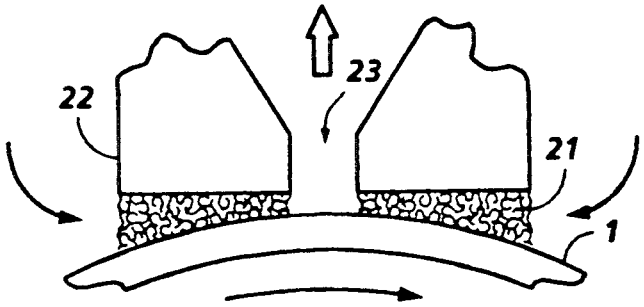
FIG. 3 is an enlarged, partial side view of an alternative embodiment of the cleaning system of FIG. 1.

The cleaning apparatus in the embodiment shown in FIG. 3, includes open-cell foam pad 21 adhered to the face of a cleaner housing 22 adjacent to a slit opening 23. A vacuum source 10 provides a negative pressure to slit 23. The foam pad covers the face of a surface of cleaner housing 22 adjacent photoconductive surface 1 but does not cover slit 23. The foam is pressed gently into sliding contact with the imaging surface to be cleaned and recycled for further imaging. In this way, the foam acts like a random array of cleaning blades, and also permits loosened toner to be carried away by moving air from the vacuum source.

Figure 4:
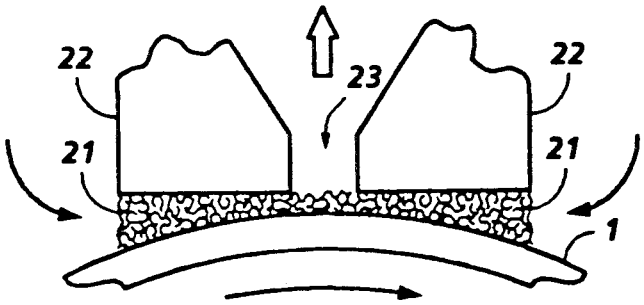
FIG. 4 is an enlarged, partial side view of yet another alternative embodiment of the cleaning system of the present invention.

Alternatively, as shown in FIG. 4, open-cell foam pad 21 is adhered to the face of cleaner housing 22 as shown in FIG. 2, but this time is covering slit opening 23. In use, the foam covered slit is brought into contact with the imaging surface (photoreceptor or electroreceptor) or photoconductive surface 1 in order to loosen and sweep residual toner away from the photoconductive surface. The cleaner embodiement of FIG. 2 is preferred over this embodiment because if the foam bridges across the slit, there will be zero air velocity at the photoconducitve surface at the center of the slit. With either embodiment, very little space is occupied around the drum on which the photoconductive surface is mounted and air blower power is lessened. Conducting or non-conducting pads could be used, if desired. Also, a seamed image surface can be beneficial for use with this invention in that "declogging" of the foam pads could be accomplished.

In summary, a low cost vacuum cleaner is dislosed in which fiber-like bristles are adhered to the face of a slit through which air is pulled by a vacuum pump and the foam is pressed gently into sliding contact with the imaging surface to be cleaned and recycled. This method of cleaning allows agitation of toner to take place where the flow is greatest.

While this invention has been described with reference to the structures disclosed herein, they are not confined to the details as set forth and are intended to cover modifications and changes that may come within the scope of the following claims.

What is claimed is:

1. A cleaning device for removing residual toner form an imaging surface, comprising:
   - a housing means having first and second surface portions thereof extending in a plane coextensive with and adjacent to the imaging surface with a slit therethrough;
   - open-cell foam means adhered to said first and second surface portions of said housing adjacent said slit and adapted for positioning in sliding contact with an imaging surface; and
   - a vacuum source adapted to suction toner through said slit loosened on an imaging surface by said open-cell foam means, and wherein said open-cell foam means in adapted to shape a profile of air velocity of said vacuum source to peak where toner is being disturbed.

2. The cleaning device of claim 1, including an imaging member and wherein said imaging surface includes at least one seam.

3. A method for removing residual toner from an imaging surface, comprising the steps of:
   - providing a housing means having a surface thereof with a slit therethrough; and
   - providing open-cell foam means adhered to said surface of said housing adjacent said slit;
   - positioning said housing means adjacent the surface to be cleaned;

contacting the surface to be cleaned with said open-cell foam means to thereby remove residual toner from the surface to be cleaned;

providing a vacuum source adapted to suction toner that is loosened on an imaging surface by said foam means into and through said slit; and shaping a velocity profile of air velocity of said vacuum source to peak where toner is being disturbed.

4. A cleaning device for removing residual toner from an imaging surface, comprising;

a housing means having a surface thereof with a slit therethrough;

open-cell foam means adhered to said surface of said housing and covering said slit and adapted for positioning in sliding contact with an imaging surface; and a vacuum source adapted to suction residual toner thorugh said slit loosened on an imaging surface by said open-cell foam means, and wherein said open-cell foam means is adapted to shape a profile of air velocity of said vacuum source to peak where toner is being disturbed.

5. A cleaning device for removing residual toner from an imaging surface, comprising:

a housing means having first and second surface portions thereof extending in a horizontal plane adjacent the imaging surface with opposing third and fourth portions thereof orthogonal with respect to said horizontal plane and forming a slit therethrough; and velvet-like flocked bristle means adhered to said first and second surface portions of said housing in said horizontal plane adjacent the imaging surface and extending to said third and fourth orthogonal portions of said slit and adapted for positioning in sliding contact with the imaging surface.

6. The cleaning device of claim 5, wherein said housing means includes a vacuum source adapted to suction toner that is loosened on an imaging surface by said velvet-like flocked bristle means into and through said slit, and wherein said velvet-like flocked bristle means is adapted to shape a profile of air velocity of said vacuum source to peak where toner is being disturbed.

7. The cleaning device of claim 5, wherein said slit is about 2.5 mm in width, and wherein said surface portion of said housing means is about 3 mm on each side of said slit, and wherein said velvet-like flocked bristle means comprises bristles of about 25 micrometers in diameters with a length of about 1.0 mm and a density of $300{,}000/cm^2$ in order to control a velocity of an air stream through said slit and along the imaging surface where residual toner is being loosened.

* * * * *